United States Patent [19]

Rasigade

[11] 3,998,132

[45] Dec. 21, 1976

[54] JACKS

[75] Inventor: Herve Pierre Rasigade, Compiegne, France

[73] Assignee: Poclain, Le Plessis-Belleville, France

[22] Filed: Oct. 14, 1975

[21] Appl. No.: 622,041

[30] Foreign Application Priority Data

Oct. 21, 1974 France ..... 74.35342

[52] U.S. Cl. ..... 91/395; 91/401; 91/406; 91/407; 91/446

[51] Int. Cl.[2] ..... F15B 15/22

[58] Field of Search ..... 91/395, 401, 392, 406, 91/405, 407

[56] References Cited

UNITED STATES PATENTS

| | | | |
|---|---|---|---|
| 2,578,810 | 12/1951 | Kilor et al. | 91/395 |
| 2,948,263 | 8/1960 | Royer | 91/401 |
| 3,173,337 | 3/1965 | Cunningham | 91/395 |
| 3,213,760 | 10/1965 | Carr | 91/395 |

FOREIGN PATENTS OR APPLICATIONS

| | | | |
|---|---|---|---|
| 1,810,366 | 11/1968 | Germany | 91/401 |

*Primary Examiner*—Paul E. Maslousky
*Attorney, Agent, or Firm*—Mason, Fenwick & Lawrence

[57] ABSTRACT

The piston of a fluid ram is provided with an end of stroke braking means comprisng a pusher adapted to contact the end wall of the ram cylinder as the piston approaches the end wall to restrict the flow of fluid from the outlet chamber of the ram to an outlet part. As the ram moves nearer the end the pusher opens a valve in the piston to connect the inlet chamber of the ram to the outlet part.

3 Claims, 4 Drawing Figures

JACKS

Figure 1:
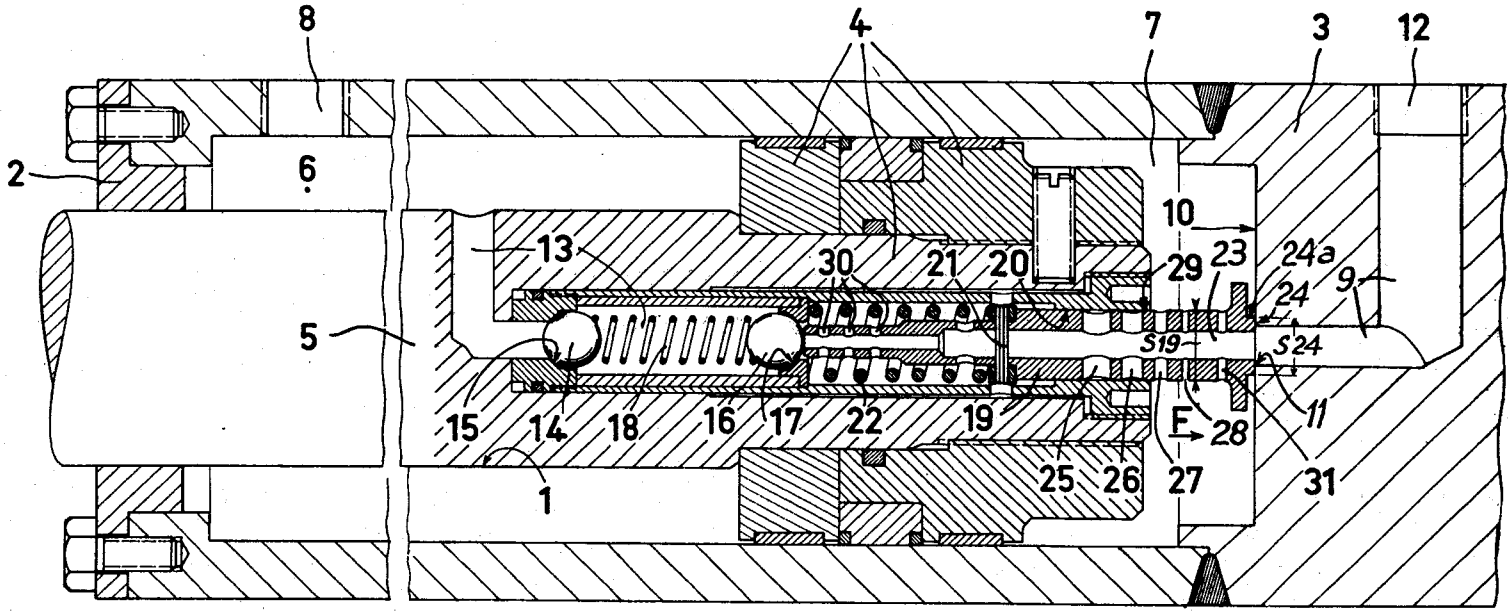

This invention relates to fluid jacks.

In the field of fluid jacks, especially hydraulic jacks, devices are already known which bring about end-of-stroke damping when the jack finishes its motive stroke.

An object of the invention is to provide a simple damper device.

Another object of the invention is to provide an integrated discharge valve as a limiter of the pressure of the fluid contained in the delivery chamber.

According to the present invention there is provided a jack comprising: a cylinder; a piston mounted to slide in the cylinder; a first chamber defined within the cylinder on a first side of the piston; a second chamber defined within the cylinder on the other side of the piston; a discharge duct connecting the second chamber to the outside of the cylinder; and a pusher mounted to slide in the piston, the pusher being arranged opposite the end of the cylinder defining the second chamber and being coupled to a position-restoring member the effect of which is to tend to keep the pusher partially out of the piston, the outer end of the pusher being arranged to bear against the said end defining the second chamber as the piston approaches the end of a stroke towards that end to block direct communication between the second chamber and the discharge duct, and at least one aperture being arranged in the pusher for establishing secondary communication between the second chamber and the discharge duct, the outer end of the pusher having a sectional area less than that of the outer face of the said pusher, so that the effect of the pressure of the fluid contained in the second chamber upon the difference between the two sectional areas creates a force opposite to that of the restoring member, the force is sufficient, when the said outer end is bearing against the said end of the cylinder defining the second chamber and the pressure reaches a predetermined value, to lift the pusher out of contact with the said end and thereby re-establish direct communication between the second chamber and the discharge duct.

Preferably the pusher has an axial cavity which, when the pusher is bearing against the said end of the cylinder, is in communication with the discharge duct then at least one aperture comprising gauged orifices which extend radially from the axial cavity to the outer cylindrical face of the pusher and are axially spaced, the said outer face being arranged to slide in an oiltight manner in the piston in such a way that the said orifices are masked one after another by the piston during the return of the pusher into the piston after the pusher contacts the said end of the cylinder.

It may be advantageous if a communicating duct passes through the piston for connecting the first chamber to the discharge duct, a first non-return valve being arranged in the communicating duct so as to allow flow of fluid from the first chamber towards the discharge duct, and a second non-return valve being arranged in the communicating duct downstream of the first non-return valve with respect to the first chamber so as to allow flow of fluid from the discharge duct towards this first chamber, and wherein the pusher is arranged opposite the movable member of the second non-return valve and is kept in a first position in which it does not interfere with the said movable member when it is out of contact with the end of the cylinder defining the second chamber by means of the restoring member, and in a second position in which it opens the second non-return valve when it bears against the said end.

Figure 2:
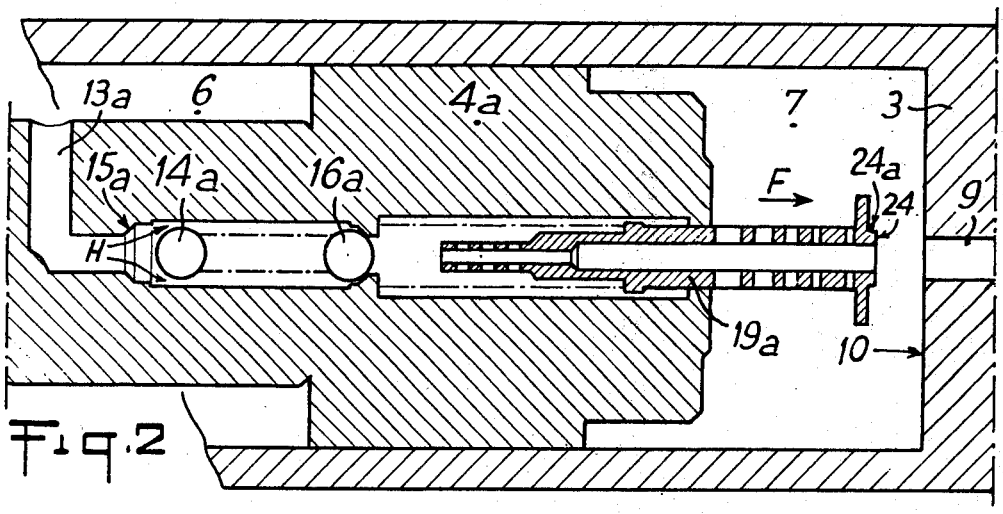
Figure 3:
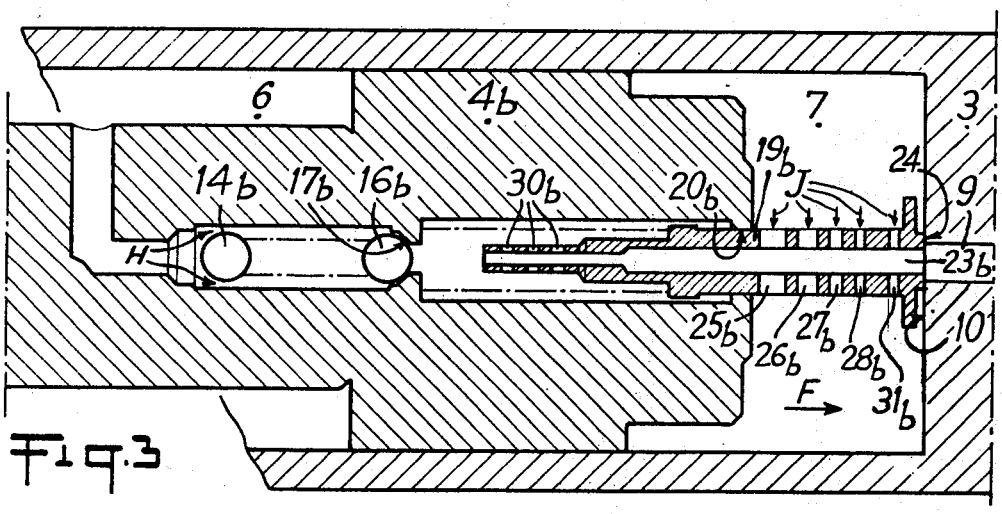
Figure 4:
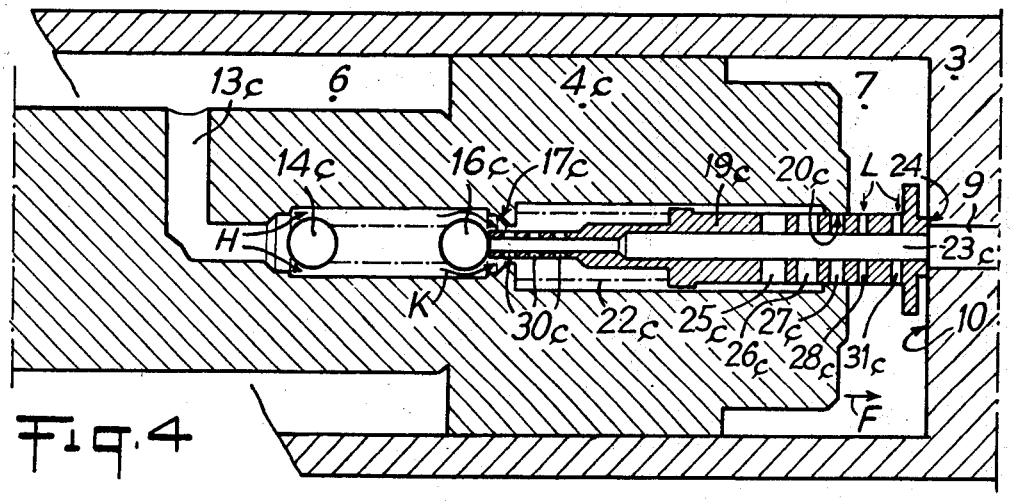

The invention will be better understood and secondary characteristics as well as their advantages will become apparent from the following description of a preferred embodiment thereof, given below by way of example only, reference being had to the accompanying drawings in which:

FIG. 1 is a detailed axial section of an embodiment of a jack in accordance with the invention, FIGS. 2 to 4 are schematic axial sections of the jack of FIG. 1 showing the jack in a number of other configurations.

The jack of FIG. 1 comprises a cylinder 1 bounded by end walls 2 and 3, a composite piston 4 including a number of related elements, and a piston rod 5 extending from the piston 4 through the end wall 2. Defined within the cylinder 1 are a first chamber 6 between the piston 4 and the end wall 2, and a second chamber 7 between the piston 4 and the end wall 3. A connection 8 connects the first chamber 6, in this particular case, to a source of fluid under pressure, such as the delivery pipe from a pump. A duct 9, which opens into the inside of the cylinder through an orifice 11 in the inner face 10 of the end wall 3 and to the outside of the cylinder through a connector 12, is, in this particular case, connected to a discharge tank.

A communicating duct 13 is arranged in the piston 4 and in the piston rod 5 and opens into the chamber 6. A ball 14 of a first non-return valve bears sealingly against a seating 15 and is contained in the duct 13. A ball 16, likewise contained in the duct 13 and forming the movable member of a second non-return valve is arranged downstream of the ball 14 with respect to the chamber 6 and bears sealingly against a seating 17. A spring 18 is interposed between the balls 14 and 16 in order to keep them bearing against their respective seatings. The ball 14 allows flow of fluid only from the chamber 6 towards the ball 16. On the contrary the ball 16 allows flow of fluid only towards the chamber 6 except when it is lifted out of contact with its seating 17 by a pusher 19. This pusher 19 is mounted to slide in the piston 4 in an fluid-tight manner in a bore 20 in this piston, is kept coupled to the piston by a transverse key 21, and is kept clear of the ball 16 in the outlet position with respect to the piston 4 by the force of a spring 22. The pusher 19 is moreover located axially in the cylinder and is arranged opposite on the one hand the ball 16 and on the other hand the orifice 11. It includes an axial cavity 23 which when its end 24 outside the piston 4 is bearing against the face 10 of the end wall 3 is in communication with the pipe 9. It should be observed that in that case in the aforesaid position the pusher 19 interrupts direct communication between the chamber 7 and the duct 9.

However, a number of gauged orifices 25,26,27,28, and 31 pass radially through the pusher 19, are spaced axially from the face 24 and form constrictions which connect the outer face 29 of the pusher with its cavity 23. These orifices are masked by the bore 20 in proportion as the pusher 19 is driven into the piston 4 during the end of the stroke of the piston in the direction of the arrow F, the stroke which brings the said piston up to the end wall 3.

Finally the end of the pusher adjacent the ball 16 is likewise provided with radial orifices 30 which connect the interior of the duct 13 to the axial cavity 23.

The pusher 19 has a main cylindrical surface 29 which is of larger diameter than the extreme end portion 24*a* immediately inward of and adjacent the end face 24 of the pusher member as shown in FIGS. 1 and 2. Consequently, when the end face 24 is engaged with bearing face 10 the pressure in chamber 7 creates a resultant force which acts to urge pusher 19 to the left by an amount equal the pressure in chamber 7 times the difference between area $S_{19}$ (the area of a circle having a diameter equal to the diameter of the larger cylindrical portion 29) and the area $S_{24}$ (an area equal the surface of a circle having a diameter equal the diameter of the smaller end cylindrical area 24*a*).

Effacement of the orifices 25 to 28 and 31 in the bore 20 is progressive. This progressiveness is shown up when looking at FIGS. 2 to 4 in which are shown the successive configurations of the jack during the stroke of the piston in the direction of the arrow F.

The elements coupled to the piston already referenced previously preserve their reference numbers followed respectively by the letters *a*, *b* and *c* for the configurations of FIGS. 2, 3 and 4. The various configurations succeed one another in the following order: Those of FIGS. 2 and 3, that of FIG. 1, then that of FIG. 4.

In FIG. 2 the fluid under pressure contained in the chamber 6 lifts the ball 14*a* off its seating 15*a* (arrow H) but on the contrary contributes to keeping the ball 16*a* bearing firmly against its seating. It will be observed that the pusher 19*a* is in the configuration which is furthest from the ball 16*a*, out of contact with this ball. The fluid delivered by the piston 4*a* out of the chamber 7 escapes freely through the orifice 11 and the duct 9.

As the stroke of the piston proceeds the piston arrives at the position shown in FIG. 3. The fluid from the chamber 6 continues to lift the ball 14*b* but still comes up against the ball 16*b* arranged on its seating 17*b*. The face 24*b* of the pusher 19*b* is bearing against the face 10 of the end wall 3, the other end of the pusher, however, is not yet in contact with the ball 16*b*. The fluid contained in the chamber 7 can only escape from this chamber by the route indicated by the arrows J, through the orifices 25*b*, 26*b*, 27*b*, 28*b* and 31*b* and the axial cavity 23*b*.

As the stroke of the piston continues the said piston arrives at the position shown in FIG. 1. The inner end of the pusher 19 is then just bearing against the ball 16, but had not yet been lifted.

Finally one arrives at the configuration of FIG. 4 in which the pusher 19*c* has actually lifted the ball 16*c* out of contact with its seating 17*c*. In this way the fluid contained in the chamber 6 enters the first portion of the duct 13*c*, lifts the ball 14*c* and passes through the orifices 30*c* (arrow K) to the axial cavity 23*c* and the duct 9. The gauged orifices 25*c*, 26*c* and 27*c* being now blocked off by the bore 20*c*, only the orifices 28*c* and 31*c* remain open, through which (arrow L) escapes the fluid contained in the chamber 7.

Several advantages are obtained by adopting the jack which has just been described.

Firstly it is clear that the jack may be fed with fluid under pressure through either of the connectors 8 and 12. If feed is through the connector 8, the piston is pushed in the direction of the arrow F, the ball 16 preventing the fluid from the chamber 6 from escaping except during the period at the end of the stroke. If feed is through the connector 12, the piston is forced in the direction opposite to the arrow F, the ball 14 this time preventing the escape of the fluid under pressure out of the chamber 7.

When the piston reaches the end of its stroke in the direction of the arrow F the pusher is brought to bear against the face 10 of the end wall 3. Fluid in the chamber 6 continues to push the piston, but the latter is braked because the fluid from the chamber 7 can no longer escape except through gauged orifices forming constrictions, first of all the orifices 25*b*, 26*b*, 27*b*, 28*b* and 31*b* (FIG. 3) and then the orifices 27, 28 and 31 (FIG. 1) and finally the orifices 28*c* and 31*c* (FIG. 4) which are moreover ultimately closed in their turn. Hence one obtains progressive braking.

In addition, when the piston reaches the position shown in FIG. 4, the ball 16*c* is lifted. Then the fluid from the chamber 6 escapes towards the duct 9. In this way its pressure is reduced to low value and the thrust which it was exerting on the piston 4 likewise drops. It should be observed that this cessation of thrust occurs always at a precise location at the end of the stroke of the piston, namely, that at which the pusher 19*c* lifts the ball 16*c*.

It should be observed in looking at FIG. 3 that if the pressure in the chamber 7 rises abnormally above a predetermined level it acts upon the radial surface of pusher 19 immediately outward from cylindrical surface 24*a* to overcome the force of spring 22 and move the pusher 19 to the left to clear duct 9 and permit pressure in chamber 7 to immediately fall to a lower level. This action is achieved by virtue of the fact that cylindrical surface 24*a* is of a lesser diameter than the diameter of the main portion 29 of the pusher member.

Of course, a pusher similar to the pusher 19 can be fitted to the other face of the piston 4 in order to obtain similar operation during the piston stroke which is the reverse of the foregoing.

Moreover the invention is not restricted to the embodiment which has been described but on the contrary covers any variants which might be applied to it without departing from its scope or its spirit.

What is claimed is:

1. A jack comprising: a cylinder; a piston mounted to slide in the cylinder; a first chamber defined within the cylinder on a first side of the piston; a second chamber defined within the cylinder on the other side of the piston; said second chamber having an end wall facing said piston; a discharge duct in said end wall connecting the second chamber to the outside of the cylinder; a pusher having a main cylindrical surface mounted to slide axially in the piston, the pusher having an end face facing said end wall of the second chamber, biasing means urging the pusher partially out of the piston toward said end wall, said end face of the pusher being arranged to bear against the said end wall as the piston approaches the end of a stroke towards said end wall to block direct communication between the second chamber and said discharge duct, aperture means arranged in the pusher for establishing secondary communication between the second chamber and the discharge duct through said pusher, the end face of the pusher having a diameter that is less than the diameter of said main cylindrical surface so that the effect of the pressure of the fluid contained in the second chamber creates a resultant force on said pusher opposite to the force of said biasing means, said resultant force being sufficient when said end face is bearing against said end wall and the pressure reaches a predetermined value to move the end face of the pusher out of contact with the said end wall to move the pusher and establish direct communication between the second chamber and the discharge duct to lower the pressure in said second chamber.

2. A jack as in claim 1, wherein the pusher has an axial cavity which, when the pusher is bearing against the said end wall of the second chamber, is in communication with the discharge duct, said aperture means comprising a plurality of axially spaced gauged orifices which extend radially in said pusher from the axial cavity to the outer main cylindrical surface of the pusher, said main cylindrical surface being arranged to slide in an oil-tight manner in the piston so that said orifices are blocked from communication with said second chamber one after another by the piston during the movement of the pusher into the piston after the end face of the pusher contacts the end wall of the second chamber.

3. A jack as in claim 2, wherein a communicating duct passes through the piston for connecting the first chamber to the discharge duct, a first non-return valve arranged in the communicating duct to as to allow flow of fluid from the first chamber towards the discharge duct, and a second non-return valve having a movable valving member arranged in said communicating duct downstream of the first non-return valve with respect to the first chamber so as to allow flow of fluid from the discharge duct towards said first chamber, and wherein the end of said pusher opposite said end face is positioned adjacently facing the movable member of the second non-return valve and is positioned by said biasing means in a first position in which it does not contact said movable valving member of said second non-return valve when it is out of contact with said end wall of the second chamber but wherein contact of said end face of said pusher with said end wall followed by subsequent movement of said piston toward said end wall effects movement of the pusher into engagement with said moveable valving member of said second non-return valve to open said second non-return valve.

* * * * *